US005557082A

United States Patent [19]

Leet et al.

[11] Patent Number: 5,557,082

[45] Date of Patent: Sep. 17, 1996

[54] CIRCUIT BREAKER WITH COMMON TRIP MECHANISM

[75] Inventors: Edward Leet; Manuel F. V. Ribeiro; Carlos A. Ferreira, all of Transvaal, South Africa

[73] Assignee: Circuit Breaker Industries Limited, South Africa

[21] Appl. No.: 270,491

[22] Filed: Jul. 5, 1994

[30] Foreign Application Priority Data

Jul. 6, 1993 [ZA] South Africa ..... 93/4839

[51] Int. Cl.[6] ..... H01H 73/02

[52] U.S. Cl. ..... 200/50.35; 335/9

[58] Field of Search ..... 200/50 R, 50 C; 218/1, 2, 5, 7; 335/6–11, 196–204

[56] References Cited

U.S. PATENT DOCUMENTS 3,786,380 1/1974 Harper ..... 335/9

3,840,833 10/1974 Mrenna et al. ..... 337/43

4,347,488 8/1982 Mune et al. ..... 335/9

4,727,226 2/1988 Comtois et al. ..... 200/50 C

*Primary Examiner*—Brian W. Brown

*Assistant Examiner*—Michael A. Friedhofer

*Attorney, Agent, or Firm*—Ladas & Parry

[57] ABSTRACT

A circuit breaker mechanism is provided with a U-shaped tripping lever which has a base and first and second parallel legs. The tripping lever is arranged around the magnetic frame of the circuit breaker and is mounted on pivot points which coincide with the pivot axis of the circuit breaker armature. On one leg is an outwardly extending projection, while on the other leg is a complemental cavity. A number of circuit breakers can be assembled side-by-side, with the projection on the tripping lever of a first circuit breaker engaging the cavity in the tripping lever of an adjacent circuit breaker. Thus, when one circuit breaker is tripped, the others are tripped together with it.

3 Claims, 2 Drawing Sheets

CIRCUIT BREAKER WITH COMMON TRIP MECHANISM

BACKGROUND OF THE INVENTION

THIS invention relates to a circuit breaker mechanism, and to circuit breakers employing the mechanism, with a common trip function.

In certain applications employing multiple circuit breakers which are arranged side by side, it is desirable that tripping of one circuit breaker should automatically cause tripping of one or more associated circuit breakers.

This may be required, for example, when a circuit breaker is tripped as a result of an overload on one phase of a multi-phase electrical installation.

Various common trip mechanisms have been proposed. However, existing mechanisms of this kind suffer from limitations in the tripping force which can be applied between adjacent circuit breakers, and the play between the common trip components of adjacent circuit breakers may accumulate, when a number of circuit breakers are interconnected, to a point where tripping becomes slow or unreliable.

SUMMARY OF THE INVENTION

According to the invention a circuit breaker mechanism comprises:

a magnetic frame;

a coil arranged to carry a load current and to induce a magnetic flux in the frame corresponding to the load current;

an armature with associated contacts mounted pivotally on or adjacent to the frame and arranged to be moved under the urging of the magnetic flux between a first, operative position in which the contacts are closed and a second, tripped position in which the contacts are open; and a tripping lever comprising a substantially U-shaped member having a base and first and second substantially parallel legs, the tripping lever being disposed about the frame and being mounted on or adjacent to the frame by respective pivot points on each leg intermediate the ends thereof, for pivotal movement under the urging of the circuit breaker mechanism when the circuit breaker is tripped, the first leg having a projection formed thereon which extends transversely therefrom, and the second leg defining a cavity shaped complementally to the projection on the first leg, the projection on the first leg of the tripping lever being engagable with the cavity defined in the second leg of the tripping lever of an adjacent circuit breaker, so that the tripping of the circuit breaker causes tripping of the adjacent circuit breaker.

The pivot points of the legs of the tripping lever are preferably mounted on the pivot axis of the armature.

The projection on the first leg and the complemental cavity defined by the second leg are preferably shaped to fit snugly together, to minimise rotational play therebetween.

For example, the projection may have a hexagonal section, with the cavity being shaped complementally.

Preferably, the projection on the first leg and the cavity defined by the second leg coincide with the pivot axis of the armature.

The tripping lever may comprise first and second components joined together at the base of the U.

Preferably, the first component has a portion which forms part of the base of the U with a spigot thereon, the second component having a corresponding portion forming another part of the base of the U with a socket therein for receiving the spigot, allowing the first and second components to be fitted snugly together end to end to form the tripping lever.

The invention extends to a circuit breaker comprising a housing and a mechanism as defined above, wherein the projection on the first leg protrudes through a first aperture in the housing, and the cavity defined by the second leg is recessed behind a second aperture in the housing.

DESCRIPTION OF AN EMBODIMENT

Figure 1:
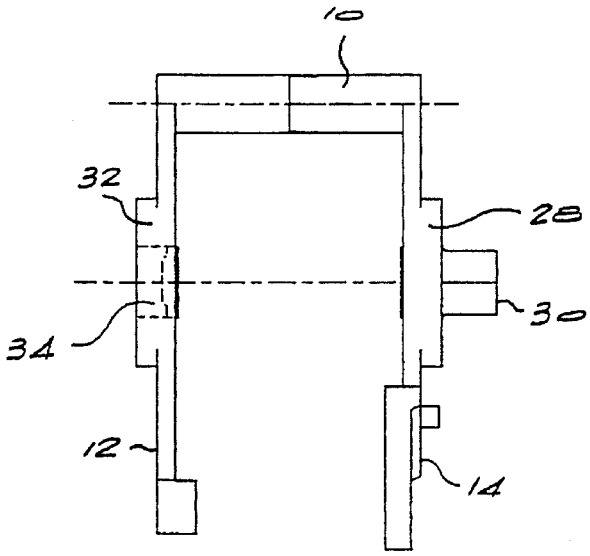
FIG. 1 is a plan view of a tripping lever for a circuit breaker mechanism according to the invention.
Figure 2:
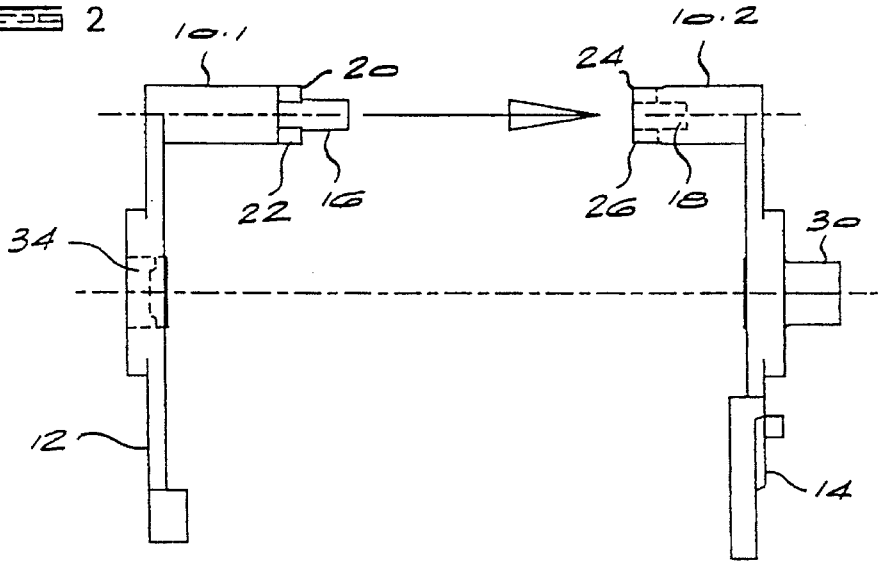
FIG. 2 is an exploded view of the tripping lever of FIG. 1, showing its component parts.

The tripping lever illustrated in FIGS. 1 and 2 is moulded from tough plastics material such as reinforced nylon in two components which fit together tightly to form a single U-shaped tripping lever. The tripping lever has a base 10 and a pair of legs 12 and 14 which extend substantially parallel. The base portion 10 of the tripping lever is circular in section.

As shown in FIG. 2, the two components which make up the tripping lever each include a portion 10.1 or 10.2 of the base. The base portion 10.1 of the first component has a keyed spigot 16 which mates with a complemental socket 18 in the base portion 10.2 of the second component. Projections 20 and 22 at the base of the spigot 16 engage complemental recesses 24 and 26 at the open end of the socket 18 when the spigot and socket are fitted together end to end, to prevent relative rotation of the base portions 10.1 and 10.2 about their common axis. The spigot and the socket are tapered slightly and are a tight fit when pushed together, so that the tripping lever is substantially rigid once assembled.

Intermediate the ends of the leg 14 is a circular boss 28, at the centre of which is formed a hexagonal projection 30 which extends transversely from the leg 14. A similar circular boss 32 is formed on the leg 12 and defines a cavity 34 which is hexagonal in section and which is complementally shaped to the projection 30, so that the projection 30 of the tripping lever of one circuit breaker can fit snugly into the cavity 34 in the tripping lever of an adjacent circuit breaker in use. Again, the projection 30 is a snug fit in the cavity 34 to minimise rotational play between the projection and the cavity. The use of a relatively strong, rigid material such as reinforced nylon for the components of the tripping lever contributes to the rigidity of the assembled lever.

Figure 3:
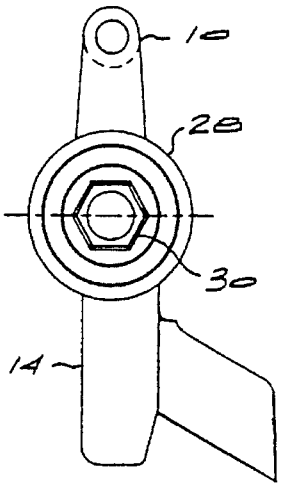
FIG. 3 is a side view of the tripping lever.

FIG. 3 is a side view of the tripping lever of FIGS. 1 and 2, showing how the hexagonal projection 30 is formed concentrically on the boss 28.

Figure 5:
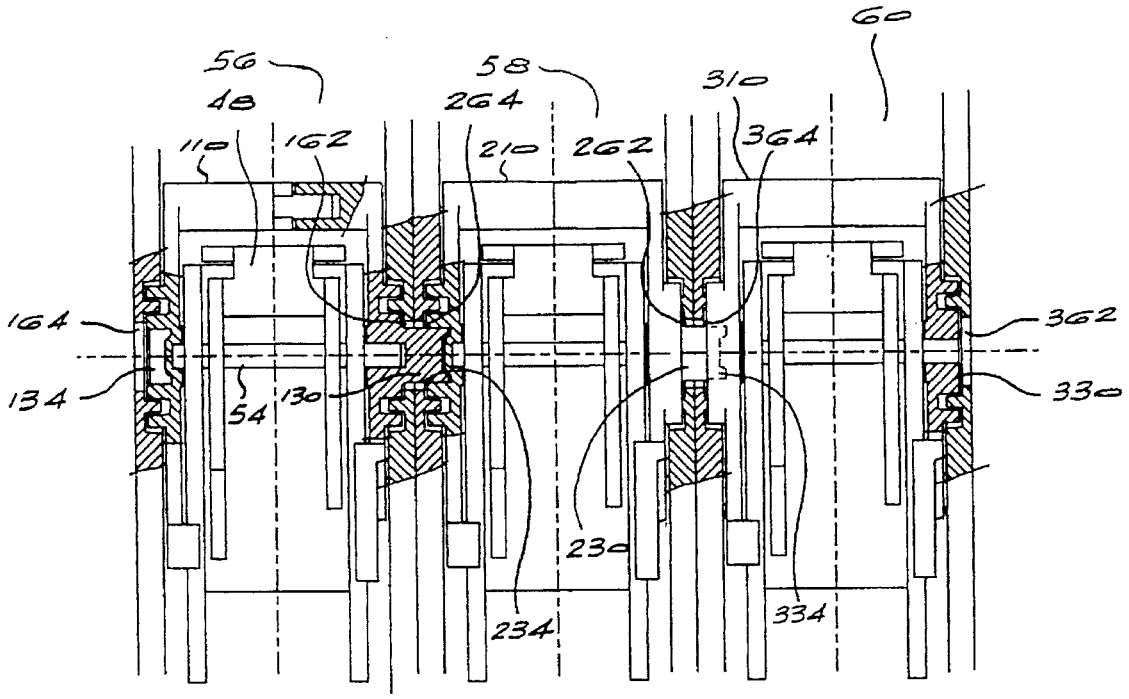
FIG. 5 is a partial sectional plan view showing the interconnection of a plurality of circuit breakers employing the common trip mechanism of the invention.
Figure 4:
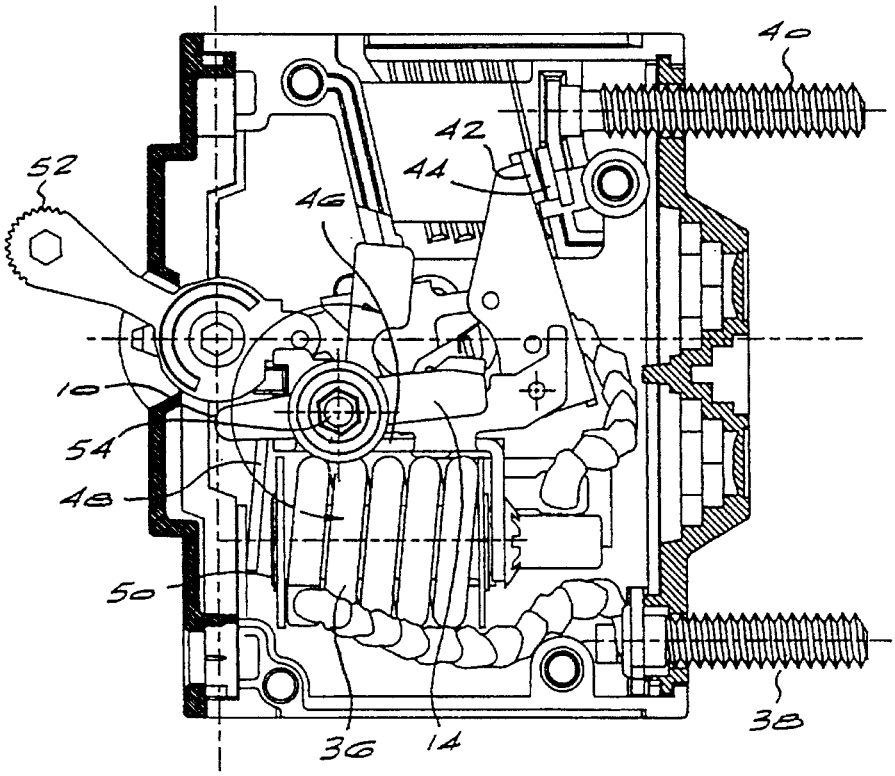
FIG. 4 is a partial sectional side view of a circuit breaker employing the common trip mechanism of the invention.

Referring now to FIGS. 4 and 5, FIG. 4 shows a circuit breaker mechanism of the kind in which a coil 36 is connected between terminals 38 and 40 via a movable contact 42 and a fixed contact 44. The coil is supported by a magnetic frame 46, and an armature 48 is mounted pivotally on (or adjacent to) the magnetic frame on a pivot pin 54 so that a magnetic flux induced in the frame by load current in the coil 36 tends to pull the armature in towards a pole piece 50 of the coil. The armature is biased by a spring (not shown) into a first, operative position corresponding to an "on" position of the circuit breaker operating handle 52 and in which the contacts 42 and 44 are closed. When the armature is pulled in to a tripped position against the pole piece due to the load current in the coil exceeding a predetermined value, the armature pivots about the pin 54 and collapses an under-centre tripping mechanism, opening the contacts 42 and 44, and moving the operating lever 52 into an "off" position.

The tripping lever is mounted around the magnetic frame and the armature, on the same pivot pin 54 as the armature 48, and pivots in the same plane as the armature, as indicated by the arrows in FIG. 4. When the circuit breaker is tripped, the collapsing trip linkage opens the circuit breaker contacts by pivoting the movable contact 42 away from the fixed contact 44. The moving contact in turn engages and rotates the common tripping lever. This rotational movement is transmitted to the common tripping levers of adjacent circuit breakers, tripping them as well.

FIG. 5 shows how the common tripping levers of three circuit breakers 56, 58 and 60 are interconnected when the circuit breakers are mounted adjacent one another. This drawing shows how the hexagonal projection 130 of the first circuit breaker is received by the complemental hexagonal cavity 234 of the second circuit breaker, via aligned openings 162 and 264 in the respective circuit breaker housings. The projection 130 protrudes beyond the side wall of its housing through the aperture 162, while the cavity 234 is recessed behind the aperture 164. Correspondingly, the hexagonal projection 230 of the second circuit breaker 58 is received by the hexagonal cavity 334 of the third circuit breaker 60, via aligned openings 262 and 364. The hexagonal projection 330 of the third circuit breaker has been cut off so that it does not protrude through the opening 362 in the right-hand side of the circuit breaker.

It can be seen that rotational force is transmitted from one common tripping lever to an adjacent tripping lever via a snug coupling between the two, on the common rotational axis of the tripping levers. This maximises the force which can be transmitted between the tripping levers. In addition, the described arrangement obviates the need for additional coupling elements which fit between the tripping levers of adjacent circuit breakers, reducing the accumulation of play between the tripping levers. This increases the precision of the common tripping function.

The two-part construction of the common tripping lever permits positioning and assembly of the common tripping lever after the main circuit breaker mechanism has been assembled. The coil spring of the common tripping lever is also independent of the main mechanism. This allows the main mechanism assembly to be mass-produced in a standard form, irrespective of whether it is to be used in single pole applications, for example, or multi-pole common tripping applications as described above.

Finally, the simple design of the components of the common tripping lever reduces the cost of the tooling required for their manufacture.

We claim:

1. A circuit breaker mechanism comprising:

a magnetic frame;

a coil arranged to carry a load current and to induce a magnetic flux in the frame corresponding to the load current;

an armature with associated contacts mounted pivotally on or adjacent to the frame and arranged to be moved under the urging of the magnetic flux between a first, operative position in which the contacts are closed and a second, tripped position in which the contacts are open; and a tripping lever comprising a substantially U-shaped member having a base and first and second substantially parallel legs, each leg having a first end joined to the base and a second end remote from the base, the tripping lever being disposed about the frame and being mounted on or adjacent to the frame by respective pivot points provided on each leg intermediate the ends thereof, for pivotal movement under the urging of the circuit breaker mechanism when the circuit breaker is tripped, the first leg having a projection formed thereon which extends transversely therefrom between the first and second ends thereof, and the second leg defining a cavity shaped complementally to the projection on the first leg between the first and second ends thereof, the projection on the first leg of the tripping lever being engagable with the cavity defined in the second leg of the tripping lever of an adjacent circuit breaker, so that the tripping of the circuit breaker causes tripping of the adjacent circuit breaker, wherein the tripping lever comprises first and second components joined together at the base of the U-shaped member, and wherein the first component has a portion which forms part of the base of the U-shaped member with a spigot thereon, the second component having a corresponding portion forming another part of the base of the U-shaped member with a socket therein for receiving the spigot, allowing the first and second components to be fitted snugly together end to end to form the tripping lever.

2. A circuit breaker mechanism according to claim 1 wherein the spigot and the socket are keyed to prevent relative rotation thereof about a common axis.

3. A circuit breaker mechanism according to claim 1 wherein the spigot and the socket are tapered complementally so that they fit together when pushed together.

* * * * *